US008087850B2

(12) United States Patent
Craig

(10) Patent No.: US 8,087,850 B2
(45) Date of Patent: Jan. 3, 2012

(54) ROCK BOLT

(75) Inventor: Peter Harold Craig, Cooyal (AU)

(73) Assignee: FCI Holdings Delaware, Inc., Pittsburgh, PA (US)

( * ) Notice: Subject to any disclaimer, the term of this patent is extended or adjusted under 35 U.S.C. 154(b) by 0 days.

(21) Appl. No.: 11/880,468

(22) Filed: Jul. 20, 2007

(65) Prior Publication Data

US 2008/0038068 A1 Feb. 14, 2008

(30) Foreign Application Priority Data

Jul. 20, 2006 (AU) ..... 2006903922

(51) Int. Cl.
*F16B 13/06* (2006.01)

(52) U.S. Cl. ..... 405/259.4; 405/259.5; 405/259.1; 411/29; 411/82.1

(58) Field of Classification Search ..... 405/258.1, 405/259.1–259.6; 411/29–34, 35, 37, 82.1, 411/82

See application file for complete search history.

(56) References Cited

U.S. PATENT DOCUMENTS

| | | | | |
|---|---|---|---|---|
| 2,685,221 | A * | 8/1954 | Barrett | 411/55 |
| 3,247,754 | A * | 4/1966 | Bieser | 411/29 |
| 3,940,941 | A * | 3/1976 | Libert et al. | 405/259.6 |
| 4,386,877 | A * | 6/1983 | McDowell, Jr. | 405/259.6 |
| 4,678,374 | A * | 7/1987 | Calandra, Jr. | 405/259.6 |
| 4,764,055 | A * | 8/1988 | Clark et al. | 405/259.2 |
| 4,861,197 | A * | 8/1989 | Calandra, Jr. | 405/259.3 |
| 5,275,512 | A * | 1/1994 | Wright | 405/259.6 |
| 2005/0025578 | A1 | 2/2005 | Ludwig et al. | |
| 2008/0008553 | A1 * | 1/2008 | Gillis et al. | 411/15 |

FOREIGN PATENT DOCUMENTS

| | | | |
|---|---|---|---|
| FR | 1369178 | * | 8/1964 |
| WO | 2004106700 A1 | | 6/2004 |

* cited by examiner

*Primary Examiner* — Sunil Singh
(74) *Attorney, Agent, or Firm* — The Webb Law Firm

(57) ABSTRACT

The present invention relates to rock bolts which may be used in mining applications. The rock bolt of this invention includes a mechanical anchoring arrangement to facilitate retaining the rock bolt in a borehole, and also a drill bit to enable self drilling of the rock bolt. Rotation of the rock bolt about an axis of the rock bolt in a first direction causes the drill bit to drill into rock and to create a borehole to receive the rock bolt. Subsequently, rotation in the opposite direction actuates a mechanical anchoring arrangement to anchor rock bolt.

14 Claims, 5 Drawing Sheets

ROCK BOLT

FIELD OF THE INVENTION

The present invention relates to a rock bolt and particularly, but not exclusively, to rock bolts which may be used in mining applications.

BACKGROUND OF THE INVENTION

Rock bolts for supporting structures e.g. roofs of passageways in mines are well known. There are many different types of rock bolts. A rock bolt generally consists of an elongate shank (length will generally depend upon the material which the rock bolt is intended to secure) having a distal end (the end which in use is fixed furthest within the rock), or "head end", and a proximal end (the end, in use, which is closest to the surface of a rock and, in many cases, may actually project from the rock surface), or "tail end".

Rock bolts are fixed in elongate boreholes (not much wider or even slightly less in width than the rock bolt) which is drilled in the rock. In use, a bearing plate is secured at the tail end of a rock bolt fast against the rock surface. The rock bolt and bearing plate assembly operate to support the rock. Many rock bolts may be used to support structures. For example, in mines rock bolts may be used to support passageways.

Installation usually requires drilling of the borehole by using a drill rig and a drill steel (a long steel rod with a drill bit on the end). The drill steel is then removed from the borehole. Resin (or "grout") is inserted into the borehole, then the rock bolt itself is inserted and tightened up against the bearing plate.

Some rock bolts incorporate point anchoring mechanisms, which can be manipulated post insertion of the rock bolt to mechanically interfere with walls of the borehole in order to firmly secure the rock bolt.

The conventional procedure for installing rock bolts can be relatively time consuming in the context of efficient mine operation. It requires a number of separate tasks (affixing the drill steel, drilling the borehole, removing the drill steel, inserting the resin and rock bolt, securing the rock bolt) which require time and a significant amount of labor. In a mining situation, where it is important that mining shafts, passageways, etc be created quickly (as this directly affects the economic operation of the mine), this is a disadvantage. Further, the drill steel and drill bit are consumables which add to the cost of installing rock bolts.

"Self drilling" rock bolts are known. These generally incorporate a drill bit as part of or connected to the head end of the rock bolt, the tail end being attachable to a drill rig in order to drill the borehole. Once the hole is drilled, the rock bolt is retained in the hole. Whilst self drilling rock bolts have the advantage of speed of application, grouting can be difficult and there are no provisions for any point anchoring mechanism to firmly secure the rock bolt.

SUMMARY OF THE INVENTION

In accordance with a first aspect, the present invention provides a rock bolt, the rock bolt including a mechanical anchoring arrangement and a drill bit to enable self drilling.

An advantage of at least an embodiment of the invention is that a self drilling rock bolt is provided which can also be mechanically point anchored.

In an embodiment, the mechanical anchoring arrangement and drill bit are arranged such that rotation of the rock bolt about an axis of the rock bolt in a first direction causes the drill bit to drill into rock (or other substrate) and create a borehole to receive the rock bolt. Subsequently, rotation in the opposite direction actuates the mechanical anchoring arrangement to point anchor the rock bolt.

In an embodiment, a tail end of the rock bolt is formed with an end fitting which is moveable axially with respect to the rock bolt after the rock bolt has been secured in the borehole, in order to allow for further take up. This may be useful in heavily fractured rock which can be compressed, for example. In an embodiment, the end fitting provides an engagement surface for a drill rig and is not axially moveable with respect to the rock bolt during drilling. In this embodiment, the end fitting may include a break out mechanism which breaks when the rock bolt is secured in the borehole, subsequently enabling axial movement. The end fitting may be a threaded nut mounted on a co-operating threaded tail end of the rock bolt. In an embodiment, instead of a break out mechanism, a fixed stop or thread deformation may prevent rotation of a nut when the borehole is being drilled.

In an embodiment, the mechanical anchoring arrangement includes an expansion assembly including an expansion shell and a co-operating chuck. In operation, the chuck and expansion shell are arranged to move relative to each other, co-operating surfaces sliding over each other and resulting in expansion of the expansion shell so that walls of the expansion shell abut against walls of the borehole and secure the rock bolt mechanically. In an embodiment, the expansion shell is arranged to rotate with the rock bolt during the drilling operation. In an embodiment, outer walls of the expansion shell include protrusions to aid mechanical interference with the borehole walls. In an embodiment, the protrusions are arranged in spiral formation to facilitate fluid and leavings flow during drilling.

In an embodiment, the mechanical anchoring arrangement is provided at one end (the head end) of the rock bolt. In some prior art, a mechanical anchoring arrangement includes a sleeve extending nearly the entire end of the rock bolt. This is not the case of this embodiment of the present invention, which only requires the head end of the rock bolt to mount a mechanical anchoring arrangement. In an embodiment where the mechanical anchoring arrangement includes an expansion shell, the expansion shell is mounted at the head end of the rock bolt.

In an embodiment, the drill bit is mounted to an end of the rock bolt and operates as a stop to prevent the chuck and expansion shell from moving off the rock bolt end. In an embodiment, the stop may comprise a surface which facilitates non seizure of the chuck. A co-operating surface (with the stop) of the chuck may also be arranged to facilitate non-seizure.

In an alternative embodiment, the drill bit is mounted by the chuck of the mechanical anchoring arrangement. The chuck in this embodiment includes a recess within which is seated the end of the rock bolt, for relative axial motion with respect to the chuck. A stop on the end of the rock bolt prevents the chuck from moving off the rock bolt during drilling.

In an embodiment, an axially extending central passageway is provided through the rock bolt to enable introduction of a cementatious material to the borehole, for grouting.

In accordance with a second aspect, the present invention provides a method of installing a rock bolt in accordance with a first aspect of the invention, including the steps of:

rotating the rock bolt in a first direction to drill a borehole in a substrate in a self drilling operation; and rotating the rock bolt in a second, opposite direction, in order to secure the mechanical anchoring arrangement in the borehole.

In an embodiment, the method includes the further step of post grouting by injecting cementatious material into the borehole. In an embodiment, where the rock bolt has an axial passageway extending within it, the cementatious material may be injected by way of the axial passageway.

BRIEF DESCRIPTION OF THE DRAWINGS

Features and advantages of the present invention will become apparent from the following description of embodiments thereof, by way of example only, with reference to the accompanying drawings, in which.

DETAILED DESCRIPTION OF EMBODIMENTS

Figure 1:
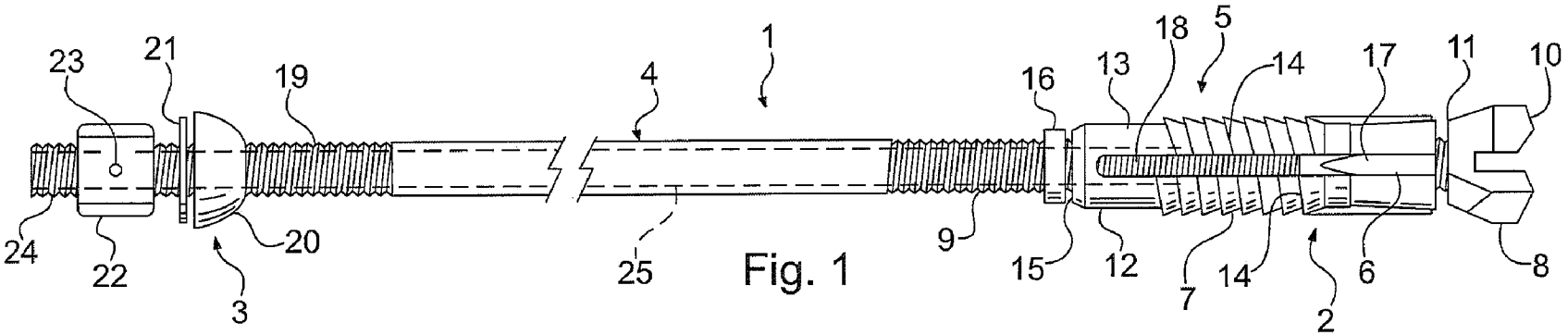
FIG. 1 is a view from one side of a rock bolt in accordance with a first embodiment of the present invention.

A first embodiment of the present invention will now be described with reference to FIGS. 1 to 3.

A rock bolt, generally designated by reference numeral 1 includes a distal, head end 2, and a proximal, tail end 3. A shank 4 extends between the head end 2 and tail end 3. The head end 2 includes a mechanical anchoring arrangement 5 which, in this example embodiment, includes a co-operating chuck 6 and expansion shell 7. The head end 2 is also provided with a drill bit 8 to enable self drilling. In this example embodiment, the drill bit 8 is mounted at the distal end of the rock bolt 1.

The mechanical anchoring arrangement 5 will now be described in more detail. Towards the head end 2, a shank 4 of rock bolt 1 is threaded with screw threads 9. The threaded portion 9 extends up to the drill bit 8. The drill bit 8 comprises a drilling tip 10 at the distal end of the rock bolt and a base forming a stop 11 where the threaded portion 9 meets the drill bit 8.

The mechanical anchoring arrangement 5 includes an expansion shell 7 and chuck 6. The expansion shell 7 in this example, has longitudinally extending leaves 12, 13 (note only two are shown in the drawings but there are three leaves). Note that the number of leaves on the expansion shell 7 could vary. For example, the leaves could vary from two to four. The leaves 12, 13 are arranged to move outwardly on expansion of the expansion shell 7 and are formed with a plurality of external protrusions 14 which assist in gripping the sides of the borehole to secure the rock bolt 1 in place. The expansion shell 7 also includes a bore 15 for sliding engagement with the threaded portion 9. An abutment member in the form of a threaded nut 16 is mounted on the threaded portion 9 and operates to prevent the expansion shell 7 from sliding further towards the tail end 3.

The chuck 6 has a threaded bore (not shown) for threaded engagement with the threaded portion 9. Rotation of the rock bolt 1 relative to the chuck 6 thus causes axial motion of the chuck 6 along the threaded portion 9. The chuck 6 includes tapered surfaces in sliding keying engagement with complementary surfaces on the extension leaves 12, 13, such that axial motion of the chuck 6 towards the tail end 3 relative to the expansion shell 7 will cause the leaves 12, 13 to diverge outwardly and grip the walls of the borehole. The chuck also includes projections 17 which extend into slots 18 formed between the leaves 12, 13 and prevent relative rotation of the chuck 6 and expansion shell 7 with respect to each other.

Stop 11 formed by the base of the drill bit 8 prevents chuck 6 and expansion shell 7 from moving over the head end of the rock bolt 1.

The protrusions 14 are in a spiral formation, to assist with the flow of fluid during drilling, and aid in clearance of filings/cuttings. The spiral runs in the opposite direction to the thread form i.e. right hand spiral for left hand thread.

The tail end 3 of the bolt 1 will now be described in more detail with reference in particular to FIGS. 1 and 3 The tail end includes a further threaded portion 19 which, in this embodiment, is threaded in the same direction (left hand) as the threaded portion 9. A ball washer 20, washer 21 and threaded nut 22 are mounted on the further threaded portion 19. In use, the ball washer abuts a mounting plate (not shown), which, when the rock bolt is installed, is hard up against the rock face.

The nut includes a torque break out mechanism 23. The nut 22 is therefore initially fixed relative to the threaded portion 19 and can be gripped by the spanner of a drill rig for rotation of the rock bolt for installation. Subsequently, when the mechanic anchoring arrangement is anchored, the torque break out mechanism 23 may be broken to allow the nut 22 to rotate relative to the threaded portion 19 to enable additional thread take up, for example, in heavily fractured rock which can therefore be compressed and partings closed.

Installation of a rock bolt 1 in accordance with the embodiment of FIGS. 1 to 3 will now be described.

A drill rig and spanner is attached to the rock bolt by way of the tensionable nut 22. Drilling into the rock substrate is implemented by rotating the rock bolt in the clockwise direction (in this embodiment. It will be appreciated that a reverse threaded arrangement may be rotated in the anticlockwise direction). As drilling proceeds, the expansion shell 7 may resist rotation as it abuts the walls of the borehole, and this will result in relative anticlockwise rotation of the expansion shell 7 and chuck 6 relative to the rock bolt 1. This will cause the chuck 6 to travel along the threaded portion 9 towards the head end of the rock bolt where it will abut the flat 11. Once flat 11 is engaged by the chuck 6 then the expansion shell 7 and chuck 6 will continue to rotate in the drilling direction with the rock bolt 1.

Once the rock bolt 1 has created a borehole of the desired length, drilling in the forward direction is ceased and rotation in the reverse direction (anticlockwise in this embodiment) is applied by the drill rig. By virtue of the anticlockwise motion of the threaded portion 9, the chuck 6 will now move towards the tail end 3. As the chuck 6 moves along the threaded portion 9, the tapered surfaces in sliding keying engagement with the complementary surfaces on the extension leaves 12, 13, cause the expansion shell 7 to expand outwardly. The protrusions 14 on the external surfaces of the leaves 12, 13 engage the walls of the borehole and mechanically secure the rock bolt 1 in place.

Once the expansion shell tightens in the borehole, continued rotation in the anticlockwise direction causes the break out mechanism 23 to break and the nut 22 to rotate relative to the further threaded portion 19, in order to tighten up against the washer 21, ball washer 20 and mounting plate (not shown). This is particularly useful where additional thread take up is required in heavily fractured rock which can be compressed and partings closed. The threaded end 24 of the rock bolt 1 remaining provides a protruding section which may be used to allow secure attachment of grout hose for post grouting applications.

A grout hose for injecting cementateous material may then be placed over the threaded end 24 so that cementateous material can be injected via the passageway 25 extending axially in the rock bolt 1. Holes (not shown) in the chuck 6 allow the cementateous material to flow into the borehole and down to the plate.

Alternatively, grout can be pumped up between the section between the borehole and the outer circumference of the rock bolt. The hollow centre of the bolt is used as a breather tube to allow air to escape as grout fills the voids.

Figure 4:
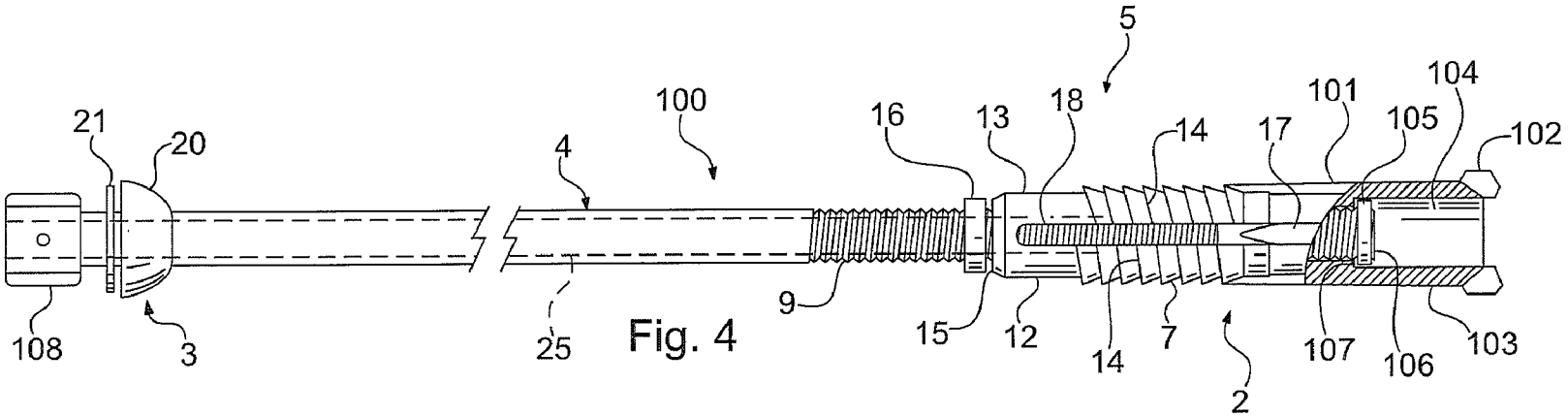
FIG. 4 is a side view of a rock bolt in accordance with a second embodiment of the present invention.
Figure 5:
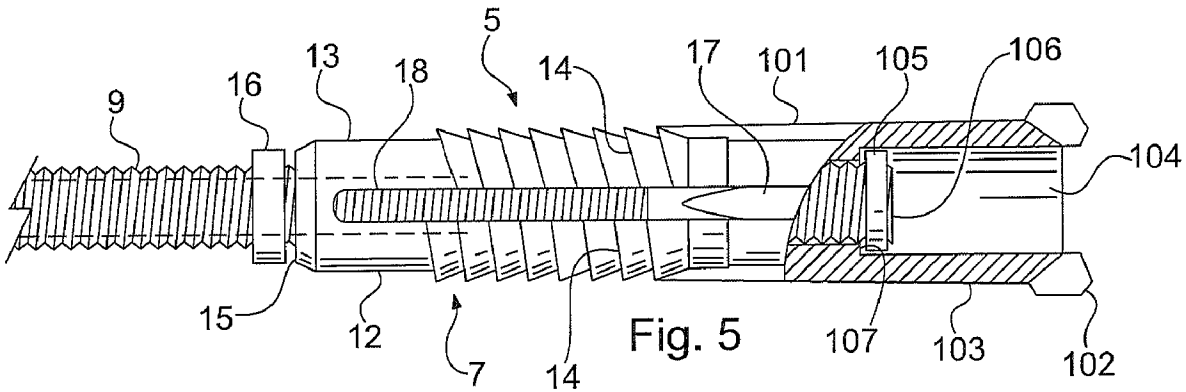
FIG. 5 is a detail of a head end of the rock bolt of FIG. 4.
Figure 6:
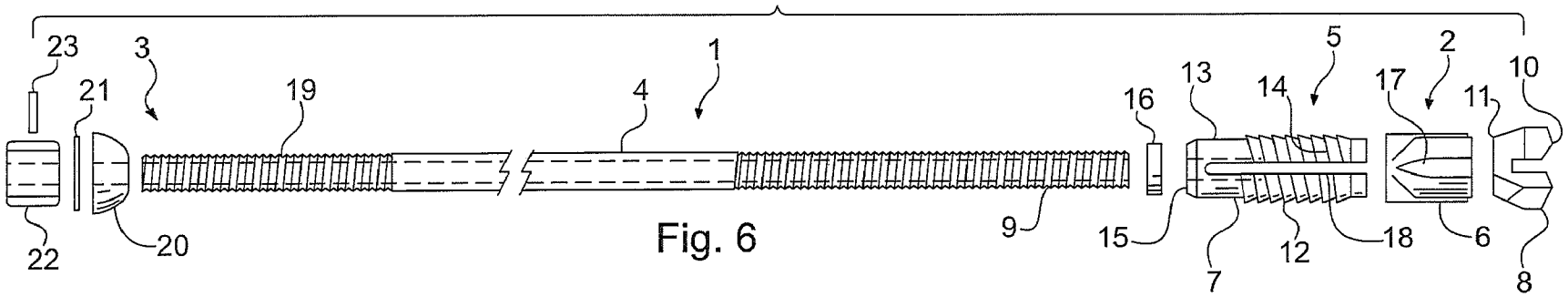
FIG. 6 is an exploded view from the side of a rock bolt in accordance with the embodiment of FIGS. 1 to 3.
Figure 7:
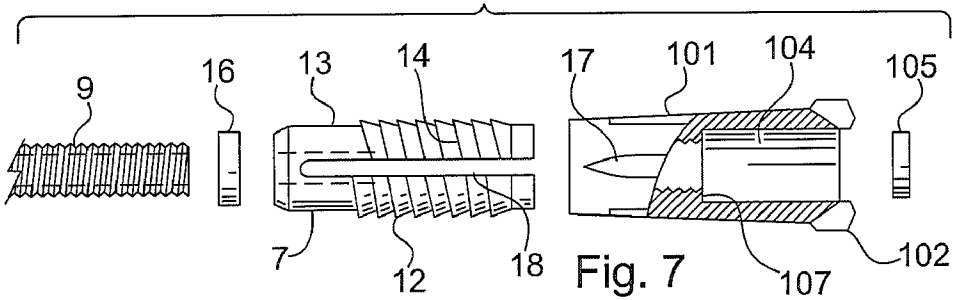
FIG. 7 is an exploded view from the side of the head end of the rock bolt of the embodiment of FIGS. 4 and 5.

A further embodiment of the present invention will now be described with reference to FIGS. 4 and 5. The rock bolt 100 includes some features which are the same as the rock bolt of FIGS. 1 to 3. These features have been allocated the same reference numerals and no further description will be given. The main differences between the embodiment of FIGS. 4 and 5 and embodiment of FIGS. 1 to 3, is in the head end 2 and tail end 3 of the rock bolt 100.

Figure 2:
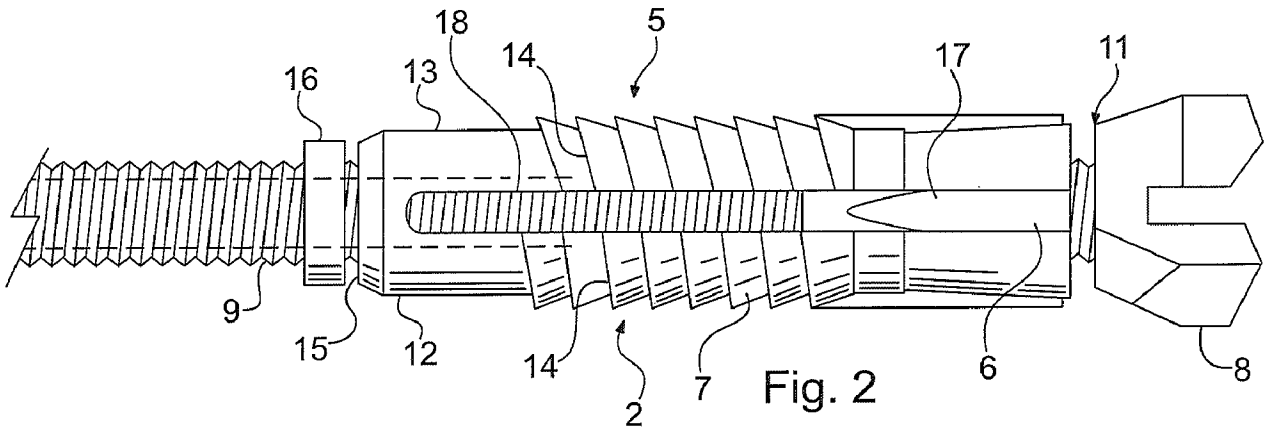
FIG. 2 is a detail of a head end of the rock bolt of FIG. 1.
Figure 3:
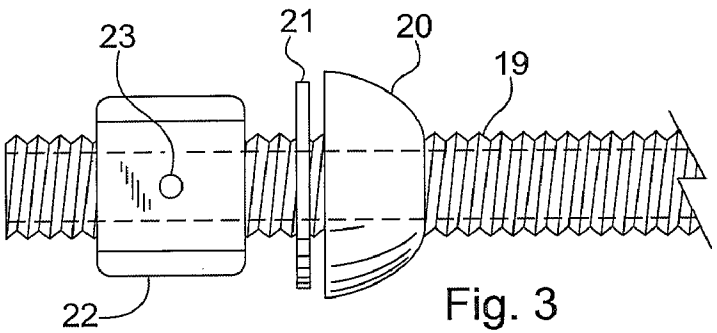
FIG. 3 is a detail of a tail end of the rock bolt of FIG. 1.

Referring firstly to the head end 2 of the rock bolt 100, although the expansion shell 7 is of the same configuration as the expansion shell 7 of the FIGS. 1 to 3 embodiment, the chuck 101 is of a different configuration. In this embodiment, the chuck 101 directly mounts the drill tip 102 on the periphery of a extension portion 103 of the chuck 101. The extension portion 103 surrounds a centre hole 104 extending within the chuck 101. The chuck 101 includes tapered surfaces in sliding key engagement with complementary surfaces of the extension leaves 12, 13, and also includes projections 17 which extend into slots 18 formed between the leaves 12, 13 and prevent relevant rotation of the chuck 101 and expansion shell 7 with respect to each other.

In this embodiment however, threaded portion 9 does not end in a stop supporting a drill bit. Instead, a fixed stop 105 is mounted at the end 106 of the threaded portion 9 extending within the centre hole 104. During drilling operation, this prevents the chuck 101 from moving off the end of the threaded portion 9. A shoulder 107 formed at the base of the centre hole 104 abuts the fixed stop 105 to prevent movement of the chuck 101 past the stop.

The tail end 3 of the rock bolt 100 is formed without any threaded portion. Instead, the tail end 3 includes a drive end in the form of a forged end portion 108 for engagement by the drill rig for drilling. Washer 21 and Ball washer 20 are slideably mounted on the shank 4 of the rock bolt 100. A hole (not shown) to suit a water spickett is also provided in the forged end 108.

In operation of this embodiment, drill rig engages the forged end 108 and rotates the rock bolt 100 in the drilling direction (in this case clockwise). The drill tip 102 is larger than the expansion shell diameter and operates directionally opposite to what is required to expand the shell.

On commencement of rotation in the clockwise direction, the chuck 101 will rotate relative to the threaded end 9 and will move along the threaded end 9 until the shoulder 107 meets the fixed stop 105. The drill bit 102 will then rotate with the drill rig, resulting in drilling of a borehole for the rock bolt 100.

On completion of the borehole, drill rotation is then applied in an anticlockwise direction. This causes the chuck 101 to move along the threaded end 9 away from the fixed stop 105 and causes expansion of the expansion shell 7 until the protrusions 14 grip the sides of the borehole and the rock bolt 100 is fixed in place.

The centre hole 104 in the chuck 101 allows the bolt end 106 to move into the void during tightening, and provides over drill. This allows tightening of end 108 compressing the rock, closing partings in the ground, etc. This allows tightening of the bolt without any tails left hanging from the wall. This is an important feature for bolting in the ribs/wall where personnel can walk and machines often hit and damage bolt tails.

As with the embodiments of FIGS. 1 to 3, post grouting can be implemented utilising the axial passageway 25.

Figure 8A:
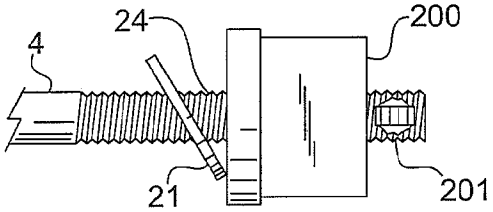
FIG. 8A and FIG. 8B are details of an alternative embodiment of a tail end arrangement for the rock bolt in accordance with an embodiment of the present invention.
Figure 8B:
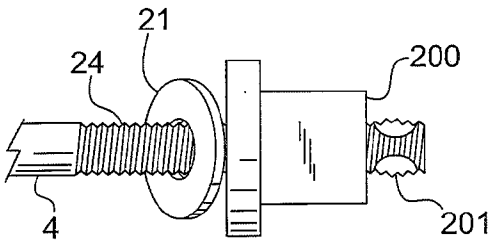

As an alternative to break out arrangement or forged end of the rock bolt, an arrangement such as that shown in FIG. 8A and 8B may be utilised at the tail end of the rocks in accordance with the embodiments described above. A threaded nut 200 is mounted at the tail end of the rock bolt. On rotation in a drilling direction, the nut 200 rotates towards the proximal end of the rock bolt where a press deformation 201 prevents travel passed the deformation 201. On completion of drilling of the borehole, and on reverse rotation of the rock bolt, the nut disengages from the deformation end and operates as discussed in relation to the embodiment of FIG. 1.

Instead of a crimp deformation, a welded ring may provide a stop to prevent the nut 200 from moving off the rock bolt during drilling. The nut 200 is a reversing nut.

Other arrangements for preventing motion of the nut during drilling and allowing motion after drilling may be employed.

Figure 9:
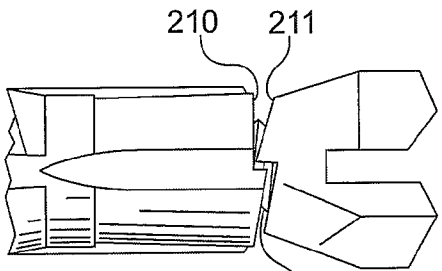
FIG. 9 is a detail of a head end for a rock bolt in accordance with an embodiment of the present invention.

In the preceding embodiments, the surfaces of the stop 11 and 105 are planar, as are corresponding abutting surfaces of the chucks in those embodiments. In some circumstances, this could potentially lead to seizure, as drilling forces may cause seizing of the chuck against the stop which would prevent opening of the expansion shell during reverse rotation, or make it more difficult. Referring to FIG. 9, in a further embodiment, in arrangement where the abutting chuck surface 210 and stop surface 211 do not make planar contact, but instead contact only particular areas (e.g. 212) may be utilised in order to facilitate non seizure. Other arrangements of surfaces may be utilised to facilitate non seizure and this embodiment is not limited to the arrangement shown in FIG. 9.

In the above embodiments, the projections which interfere with the walls of the boreholes (14) are arranged in spiral formation. Although this is advantageous, the present invention is not limited to spiral formation projections. The projections may be non-spiral. The projections may be in any form which engages with the walls of the borehole.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A self drilling rock bolt comprising:

an elongated hollow shank having a threaded portion at a head end;

a drill bit coupled to the head end of the hollow shank, the drill bit directly engaging the threaded portion of the elongated hollow shank; and a mechanical anchoring arrangement including an expansion assembly having an expansion shell and a cooperating chuck threaded to the threaded portion of the hollow shank, the chuck being arranged to rotate together with the expansion shell whereby rotation of the rock bolt in one direction provides a drilling action with the expansion shell rotating together with the hollow shank whereas rotation of said bolt in an opposite direction provides axial movement of the chuck relative to the hollow shank and the expansion shell to mechanically secure the rock bolt.

2. A self drilling rock bolt as defined in claim 1, wherein the chuck includes surfaces in sliding keyed engagement with corresponding surfaces on the expansion shell for conjoined rotation of the chuck and the expansion shell.

3. A self drilling rock bolt as defined in claim 1, wherein the expansion shell and the cooperating chuck have cooperating surfaces arranged to slide over each other resulting in expansion of the expansion shell so that walls of the expansion shell abut walls of a borehole thereby mechanically securing the rock bolt to a borehole wall.

4. A self drilling rock bolt as defined in claim 1, further comprising a drive end portion connected to a tail end of the hollow shank and being adapted for engagement by a drill rig for drilling in said one direction and mechanically securing in the opposite direction.

5. A self drilling rock bolt as defined in claim 1, wherein a base of the drill bit defines a stop which, in use, prevents the chuck from moving off the rock bolt during drilling.

6. A self drilling rock bolt as defined in claim 1, wherein the outer walls of the expansion shell include protrusions to aid mechanical interference with borehole walls.

7. A self drilling rock bolt as defined in claim 6, wherein the protrusions are arranged in spiral formation to facilitate fluid and leavings flow during drilling.

8. A self drilling rock bolt as defined in claim 1, including an end fitting which is moveable axially with respect to the hollow shank in order to allow for further take up after the rock bolt has been secured in a borehole.

9. A self drilling rock bolt as defined in claim 8, wherein the end fitting provides an engagement surface for a drill rig.

10. A method of installing a rock bolt in accordance with claim 1, including the steps of rotating the rock bolt in a first direction to drill a borehole in the rock material utilizing the drill bit in a self drilling operation; and rotating the bolt in a second, opposite direction, in order to secure the mechanical anchoring arrangement in the borehole.

11. A method as defined in claim 10, including the further step of grouting by injecting cementitious material into the borehole.

12. A self drilling rock bolt as defined in claim 1, wherein a base of the drill bit defines a stop that is configured to engage the chuck during rotation of the rock bolt to prevent movement of the chuck in a direction towards the head end of the elongated hollow shank.

13. A self drilling rock bolt comprising:

an elongated hollow shank having a threaded portion at a head end;

a drill bit coupled to the head end of the hollow shank, the drill bit directly engaging the threaded portion of the elongated hollow shank;

a mechanical anchoring arrangement including an expansion assembly having an expansion shell and a cooperating chuck threaded to the threaded portion of the hollow shank, the chuck being arranged to rotate together with the expansion shell whereby rotation of the rock bolt in one direction provides a drilling action with the expansion shell rotating together with the hollow shank whereas rotation of said bolt in an opposite direction provides axial movement of the chuck relative to the hollow shank and the expansion shell to mechanically secure the rock bolt; and an end fitting which is moveable axially with respect to the hollow shank, wherein the end fitting includes a breakout mechanism which, in use, breaks when the rock bolt is secured, enabling axial movement of the end fitting for further take up.

14. A self drilling rock bolt as defined in claim 13, wherein the end fitting is a threaded nut mounted on a cooperating threaded tail end of the hollow shank.

* * * * *